United States Patent [19]

Hotten

[11] 4,132,659

[45] Jan. 2, 1979

[54] SULFUR AND CHLORINE-CONTAINING LUBRICATING OIL ADDITIVE

[75] Inventor: Bruce W. Hotten, Orinda, Calif.

[73] Assignee: Chevron Research Company, San Francisco, Calif.

[21] Appl. No.: 866,075

[22] Filed: Dec. 30, 1977

[51] Int. Cl.[2] ..... C10M 1/38

[52] U.S. Cl. ..... 252/48.8; 260/139

[58] Field of Search ..... 252/45, 48.8; 260/139

[56] References Cited

U.S. PATENT DOCUMENTS

| | | | |
|---|---|---|---|
| 2,386,222 | 10/1945 | Lincoln et al. | 252/45 X |
| 2,500,167 | 3/1950 | Garwood et al. | 252/45 |
| 2,681,905 | 6/1954 | Garwood et al. | 252/45 X |
| 2,786,031 | 3/1957 | Givens | 252/48.8 |
| 2,878,243 | 3/1959 | Blickman et al. | 252/45 X |
| 3,316,237 | 4/1967 | Imparato et al. | 252/48.8 X |
| 3,346,549 | 10/1967 | Ford et al. | 252/48.8 X |
| 3,471,404 | 10/1969 | Myers | 252/45 |

*Primary Examiner*—Delbert E. Gantz
*Assistant Examiner*—Andrew Metz
*Attorney, Agent, or Firm*—D. A. Newell; C. J. Tonkin; L. L. Vaughan

[57] ABSTRACT

Lubricating oil additives are prepared by reacting 1-alkenes with sulfur and sulfur monochloride in the molar ratio 1:0.6-0.9:0.05-0.2. The additives have anti-wear, extreme pressure, and antioxidant properties.

10 Claims, No Drawings

SULFUR AND CHLORINE-CONTAINING LUBRICATING OIL ADDITIVE

BACKGROUND OF THE INVENTION

This invention relates to a new process for making lubricating oil additives and to the products prepared by this process. It also relates to lubricating oil compositions containing the products of this invention.

The use of halogenated and sulfurized antioxidants and antiwear agents in lubricating oil additives has long been known; however, the additives known in the art have a variety of drawbacks. In some cases, antioxidant benefits have been sacrificed to achieve improved antiwear activity. In other cases, antiwear activity is sacrificed for antioxidant activity. When attempts have been made to prepare an additive having both antioxidant and antiwear activity, the corrosivity to metals, especially copper, has been high.

A variety of approaches have been tried in the past in the attempt to find a good antiwear-antioxidant additive having low metal corrosivity. U.S. Pat. No. 2,213,988 teaches halogenated thioethers which combine sulfur and halogen in a single molecule. Other additives combine a thioether antioxidant with a chlorinated wax.

Representative of other approaches are the following:

U.S. Pat. No. 2,514,625 describes chlorinating paraffin wax to about 15% to 25% chlorine content and then condensing with sodium monosulfide and sulfur or sodium polysulfide to produce an additive containing about 10% to 20% sulfur. In an example, a chlorinated paraffin wax containing 20% chlorine is reacted with sodium monosulfide and sulfur to yield a product containing 14% sulfur and 2.5% chlorine.

U.S. Pat. No. 2,744,070 describes reacting a non-conjugated olefinic $C_6$–$C_{30}$ hydrocarbon with about a stoichiometric equivalent of a sulfur halide at 0° to 50° C. and then condensing with a water soluble inorganic higher polysulfide at 50° to 100° C.

U.S. Pat. No. 3,852,206 describes reacting a naphthenic base mineral oil with sulfuric acid and then treating the unneutralized oil with a sulfur halide to incorporate both sulfur and halogen into the oil. The additive is said to contain up to 18% by weight sulfur and up to 5% by weight total halide.

The additives manufactured by our new method are prepared in a simple and economical one-step process which produces additives having very good antioxidant and antiwear properties and very low corrosivity to metal surfaces.

SUMMARY OF THE INVENTION

The process of this invention comprises heating a mixture of a 1-alkene, sulfur, and sulfur monochloride in the molar ratio of 1 mol 1-alkene per 0.6–0.9 mols sulfur and 0.05–0.2 mols sulfur monochloride to incorporate sulfur and chlorine into the 1-alkene. Preferably, a ratio of n mol S to 1-n/2 mol $S_2Cl_2$ ($n<1$ for 1 mole alkene) is used to provide a stoichiometric balance of reagents. The mixture is heated to 140°–200° C. for 1–20 hrs. Under normal circumstances the reaction will be complete after 5–15 hours at 150°–170° C. Such shorter times and lower temperatures are preferred.

The products of this process can be used as lubricant additives without any additional treatment. If desired, the process may be carried out under a slow stream of inert gas, such as nitrogen gas, to remove any hydrogen sulfide or hydrogen chloride that might be generated.

The product generally contains from 5–20% sulfur and from 0.5–5% chlorine. For a most effective lubricating oil additive, 8–16% sulfur content and 1–3% chlorine content is preferred.

The 1-alkene used in the process of this invention is any molecule having a terminal olefinic bond whose reaction product with sulfur and sulfur monochloride is oil-soluble and possesses antioxidant and antiwear properties in lubricating oil. Generally these 1-alkenes will contain from 10 to 30 carbon atoms, more preferably from 10 to 20 carbon atoms.

Particularly preferred because of their availability and price are the 1-alkenes prepared by cracking wax. These 1-alkenes are often referred to in the art as cracked wax olefins. Various cracked wax olefin fractions may be used as starting materials for the reaction of this invention. Particularly preferred are the 1-decene (including $C_9$–$C_{10}$) fraction and the $C_{15}$–$C_{18}$ fraction.

The lubricating oil additives of this invention can be used with any relatively inert and stable fluid of lubricating viscosity. The viscosity of these lubricating fluids is generally 35–50,000 Saybolt Universal Seconds (SUS) at 100° F. (38° C.).

The fluid medium or oil may be derived from either natural or synthetic sources. Included among the natural hydrocarbonaceous oils are paraffin-base, naphthenic-base or mixed-base oils. Synthetic oils include polymers of various olefins, generally of 2 to 6 carbon atoms, alkylated aromatic hydrocarbons, etc. Nonhydrocarbon oils include polyalkylene oxide, carboxylates, phosphates, aromatic ethers, silicones, etc. The preferred media are hydrocarbonaceous media, both natural and synthetic. Preferred are those hydrocarbonaceous oils having viscosity of about 100–4,000 SUS at 100° F. The compatibility of the additives of the present invention with the lubricating medium is evidenced, among other things, by a lack of haze.

The additives of this invention are usually present in the lubricating oil composition at a concentration of 0.1 to 5% by weight. Ordinarily, the desired antioxidant and antiwear control is achieved using the preferred concentration of 0.2–2% by weight.

For ease of handling and to reduce storage costs, the additives of this invention may be prepared as concentrates in lubricating oil. The concentrates contain from 5 to 90% by weight of the additive of this invention. These concentrates are diluted with additional oil to obtain the requisite concentration prior to being used as a lubricant.

The lubricating oil compositions may contain additional additives such as dispersants, rust and corrosion inhibitors, antioxidants, oiliness agents, foam inhibitors, demulsifiers, detergents, antiwear agents, viscosity index improvers, pour point depressants, and the like. Typical of such additives are alkenyl succinimide dispersants, phenolic and aryl amine antioxidants, and zinc dihydrocarbyl dithiophosphates.

EXAMPLES

The following examples are presented for the purpose of illustrating the invention and are not intended in any way to limit the scope of the invention disclosed.

EXAMPLE A

To a 4-liter flask was added 2240g (16 mols) of $C_9$–$C_{10}$ cracked wax olefin and 512g (16 mols) sulfur. The reaction mixture was heated to 160° C. for 10 hours under nitrogen.

The mixture was filtered through diatomaceous earth at room temperature to yield 2719g of product containing 18.2% sulfur.

EXAMPLE 1

To a 4-liter flask was added 2095g (15 mols) of $C_9$–$C_{10}$ cracked wax olefin, 384g (12 mols) sulfur and 202.5g (1.5 mols) sulfur monochloride. The reaction mixture was stirred for 10 hours at 160° C. under nitrogen. The mixture was then stripped at 100° C. under vacuum to yield 2596g product containing 17.9% sulfur and 2.7% chlorine.

EXAMPLE 2

Following the general procedure of Example 1, the products shown in Table I below were prepared. The term CWO means cracked wax olefin.

TABLE I

| Ex. No. | Time, Hrs. | Temp. °C | 1-Alkene Mols | Sulfur Mols | Sulfur Monochloride, Mols | Product %S | Product %Cl |
|---|---|---|---|---|---|---|---|
| 2 | 10 | 160 | $C_{9-10}$ CWO, 1 | 0.8 | 0.1 | 18 | 2.7 |
| B | 10 | 160 | $C_{15-18}$ CWO, 1 | 1 | 0 | 11 | 0 |
| 3 | 10 | 160 | " | 0.8 | 0.1 | 12 | 1.8 |
| 4 | 10 | 160 | " | 0.9 | 0.05 | 12 | 3.1 |
| 5 | 10 | 160 | " | 0.7 | 0.15 | 12 | 3.1 |
| C | 0.25 | 80 | $C_{9-10}$ CWO, 0.44 | 0 | 0.25 | 16 | 16 |

The following examples illustrate the effectiveness of the products of this invention (Examples 1–5) as compared to those falling outside the scope of the invention (Examples A–C), as well as mixtures designed to mimic in chlorine and sulfur content of the products of this invention.

EXAMPLE 6

Table II below illustrates the advantages with respect to oxidation control of the additives of this invention over closely related types of additives.

The oxidation test measures the resistance of the test sample to oxidation using pure oxygen with a Dornte-type oxygen absorption apparatus (R. W. Dornte, "Oxidation of White Oils," Industrial and Engineering Chemistry, Vol. 28, page 26, 1936).

The conditions are: an atmosphere of pure oxygen exposed to the test oil, the oil maintained at a temperature of 171° C., and oxidation catalysts, 0.69% Cu, 0.41% Fe, 8.0% Pb, 0.35% Mn, and 0.36% Sn (as naphthenates) in the oil. The time required for 100 g of the test sample to absorb 1000 ml of oxygen is measured.

TABLE II

OXIDATION INHIBITION BY THIOETHERS

| | Thioether Additive Compound | Thioether Conc. % | Source of Chlorine Added Compound | Source of Chlorine Conc.,% | Cl in Oil,% | Life Hrs. |
|---|---|---|---|---|---|---|
| A. | In 480 SSU/100° F Neutral Oil | | | | | |
| 1. | None | — | None | — | 0.00 | 0.4 |
| 2. | Sulfidized 1-decene (Ex. A) | 1 | None | — | 0.00 | 3.4 |
| 3. | " | 2 | None | — | 0.00 | 6.7 |
| 4. | " | 1 | Chlorinated wax (40% Cl) | 0.068 | 0.027 | 3.4 |
| 5. | " | 2 | Chlorinated wax (40% Cl) | 0.014 | 0.054 | 6.9 |
| 6. | Sulfidized-sulfochlorinated 1-decene (Ex. 2) | 1 | None | — | 0.027 | 8.5 |
| 7. | " | 2 | None | — | 0.054 | 12 |
| B. | In 480 Neutral Oil Containing 6% Succinimide Dispersant and 9 mmol/kg Zinc Dialkyl Dithiophosphate: | | | | | |
| 1. | None | — | None | — | 0.00 | 4.6 |
| 2. | Sulfidized 15–18C 1-Alkenes (11%S) (Ex. B) | 1 | None | — | 0.00 | 6.1 |
| 3. | " | 1 | Chlorinated wax (40% Cl) | 0.1 | 0.04 | 7.3 |
| 4. | Sulfidized-sulfochlorinated 15–18C 1-Alkenes (Ex. 3) | 1 | None | — | 0.016 | 13.13 |

Table III shows the results of the same oxidation test as used above and illustrates the effective ranges of molar proportions of sulfur and sulfur monochloride in the preparation of additives by the process of this invention.

TABLE III

EFFECT OF $S_2Cl_2$:S RATIO WITHIN PREFERRED RANGE ON OXIDATION INHIBITION BY SULFIDIZED-SULFOCHLORIDIZED 1-ALKENE (SSA)

| Product of Example | Molar Ratio S | Molar Ratio $S_2Cl_2$ | Analysis, % S | Analysis, % Cl | SSA Conc., % | Oxidation Time to Absorption of 1 L/100q at 171° C, h. |
|---|---|---|---|---|---|---|
| A | 1 | — | 13 | — | 1.5 | 2.2 |
| 3 | 0.8 | 0.1 | 12 | 1.8 | 0.5 | 0.8 |
| | | | | | 1.0 | 6.4 |
| | | | | | 2.0 | 11 |
| 4 | 0.9 | 0.05 | 12 | 1.1 | 0.5 | 0.6 |
| | | | | | 1.0 | 2.6 |
| | | | | | 2.0 | 9.1 |
| 5 | 0.7 | 0.15 | 12 | 3.1 | 0.5 | 0.7 |

TABLE III-continued

EFFECT OF $S_2Cl_2$:S RATIO WITHIN PREFERRED RANGE ON OXIDATION INHIBITION BY SULFIDIZED-SULFOCHLORIDIZED 1-ALKENE (SSA)

| Product of Example | Molar Ratio S | Molar Ratio $S_2Cl_2$ | Analysis, % S | Analysis, % Cl | SSA Conc., % | Oxidation Time to Absorption of 1 L/100q at 171° C, h. |
|---|---|---|---|---|---|---|
| | | | | | 1.0 | 4.4 |
| | | | | | 2.0 | 10 |

Table IV shows a comparison of properties for sulfur and halogen-containing additives in the oxidation test described above, in the 4-Ball Wear test (ASTM D 2783-71, 20 kg load, 1800 rpm, 54° C.) and in the copper strip test (ASTM D130, 121° C., 3 hours). As can be seen from the results of these tests, the additives of the invention have good antiwear and antioxidant properties and low corrosivity to copper.

TABLE IV

EFFECT OF WIDE VARIATION IN $S_2Cl_2$:S RATIO ON PROPERTIES OF OLEFINS TREATED WITH S AND $S_2Cl_2$

| Compound | Additive S,% | Additive Cl % | Additive Concn.,% | Oxidator-B Life, H | 4-Ball Wear, mm | Cu Strip Test |
|---|---|---|---|---|---|---|
| None (480 SSU/100° F Neutral Oil | — | — | — | 0.4 | 0.76 | 1a |
| Product of Example A (1 mol S: 1 mol $C_9$–$C_{10}$ CWO) | 18 | — | 1 | 3.1 | 0.36 | 2a |
| Product of Example 2 (0.8 mol S: 0.1 mol $S_2Cl_2$) | 18 | 2.7 | 1 | 8.5 | 0.34 | 2ab |
| Product of Example C (1.1 mol $S_2Cl_2$:2 mol $C_{9-10}$ CWO) | 16 | 16 | 1 | 17 | 0.45 | 2c |

What is claimed is:

1. A process for preparing a lubricating oil additive which comprises heating at 140°–200° C. for 1–20 hours a mixture of a 1-alkene with sulfur and sulfur monochloride in a molar ratio of about 1:0.6–0.9:0.05–0.2 respectively to yield an additive containing 5–20% sulfur and 0.5–5% chlorine.

2. The process as claim 1 wherein the mixture is heated at 150°–170° C. for 5–15 hours.

3. The product prepared by the process of claim 1.

4. The product of claim 3 wherein the 1-alkene contains from 10–20 carbon atoms, 8–16% sulfur and 1–2% chlorine.

5. The product of claim 4 wherein the 1-alkene is a cracked wax olefin-derived mixture of 9–10 carbon atoms.

6. The product of claim 4 wherein the 1-alkene is a cracked wax olefin-derived mixture of 15–18 carbon atoms.

7. A lubricating oil concentrate comprising from 10–95% wt oil of lubricating viscosity and 90–5% wt of the product of claim 3.

8. A lubricating oil concentrate comprising from 10–95% wt oil of lubricating viscosity and 90–5% wt of the product of claim 6.

9. A lubricating oil composition comprising an oil of lubricating viscosity and from 0.1–5% wt of the product of claim 3.

10. A lubricating oil composition comprising an oil of lubricating viscosity and from 0.2–2% wt of the product of claim 6.

* * * * *